US007528396B1

(12) United States Patent
Vavroch

(10) Patent No.: US 7,528,396 B1
(45) Date of Patent: May 5, 2009

(54) SOLID STATE SIMULATOR OF MISSILE UV SIGNATURES

(75) Inventor: Larry Dee Vavroch, Palm Bay, FL (US)

(73) Assignee: L-3 Communications Titan Corporation, San Diego, CA (US)

( * ) Notice: Subject to any disclaimer, the term of this patent is extended or adjusted under 35 U.S.C. 154(b) by 265 days.

(21) Appl. No.: 11/732,555

(22) Filed: Apr. 4, 2007

(51) Int. Cl.
*H05B 37/02* (2006.01)

(52) U.S. Cl. ..... 250/504 R

(58) Field of Classification Search ..... 250/504 R
See application file for complete search history.

(56) References Cited

U.S. PATENT DOCUMENTS 5,693,951 A * 12/1997 Strong, III ..... 250/504 R

* cited by examiner

*Primary Examiner*—Kiet T Nguyen
(74) *Attorney, Agent, or Firm*—Edward W. Callan

(57) ABSTRACT

Apparatus for simulating ultraviolet (UV) signatures of missiles includes a memory, control electronics, drive electronics and at least one solid-state UV-radiation emitter. Waveform data that is characteristic of the UV-signatures of different types of missiles is stored in the memory. The control electronics retrieve specific waveform data from the memory in response to an operator's selection of at least one of one or more different types of missiles and processes the retrieved waveform data to generate a waveform signal that simulates the UV-signature(s) of the selected missile(s). The drive electronics respond to the generated waveform signal by causing the at least one solid-state UV-radiation emitter to emit UV radiation simulating the UV-signature(s) of the missile(s). The apparatus is mounted on a hand-held chassis. Operator controls are included in a hand grip of the chassis.

16 Claims, 7 Drawing Sheets

SOLID STATE SIMULATOR OF MISSILE UV SIGNATURES

BACKGROUND OF THE INVENTION

The present invention generally pertains to apparatus for simulating ultraviolet (UV) irradiance signatures of missiles.

UV signatures of missiles are simulated to test the detection portions of missile warning receivers (MWRs), which are included in systems that are used by military and commercial aircraft and other vehicles to detect, warn, and counteract attacks by missiles. The UV signatures are simulated for eject, ignition, boost and sustain phases of missile flight. Apparatus for simulating missile UV signatures generate and radiate missile UV-signature characteristics that the MWRs utilize in their operation, thus providing the ability to test these systems and the vehicles they are mounted on, and to train the crews that operate them. Prior art missile UV-signature simulators use filament light bulbs or arc lamps to emit the UV radiation.

Existing apparatus for simulating missile UV signatures are limited by either (a) the amount of UV energy they can radiate, (b) the ability to rapidly change the energy levels, or (c) false UV signatures that they present in other spectral bands; each of which limitations reduce their usefulness. It is the object of the present invention to provide an apparatus for simulating UV signatures of a missile that is not limited by these limitations of existing missile UV-signature simulators.

SUMMARY OF THE INVENTION

The present invention provides apparatus for simulating ultraviolet (UV) signatures of a missile, comprising: means for providing waveform data that is characteristic of a UV-signature of a missile; means for processing the waveform data to generate a waveform signal simulating the UV-signature of the missile; means for emitting UV-radiation; and drive means for responding to the generated waveform signal by causing the means for emitting UV-radiation to emit UV radiation simulating the UV-signature of the missile; wherein the means for emitting UV-radiation comprises at least one solid state UV radiation emitter.

The solid-state-emitter UV-signature simulator of the present invention can (a) rapidly change the level of radiated energy, and thereby closely follow the rapid dynamics of the missile UV-signature during eject, ignition, boost, sustain, and burnout phases of missile flight; (b) radiate energy in only the UV energy band utilized by the missile warning receivers; (c) scale the amount of radiated energy through the number of solid state sources used, whereby the simulator is capable of both short and long range operation; (d) be capable of having dynamic intensity digital profiles downloaded, thereby allowing for upgrading of simulation capabilities; (e) have an extended operating life without replacing bulbs; and (f) have high electrical efficiency operation.

The solid-state-emitter UV-signature simulator of the present invention generate and radiate ultraviolet missile characteristics that aircraft and vehicle MWRs utilize in their operation, thereby providing the ability to test these MWRs and the vehicles they are mounted on, and to train the crews that operate them.

Additional features of the present invention are described with reference to the detailed description of the preferred embodiments.

DETAILED DESCRIPTION

Figure 1:
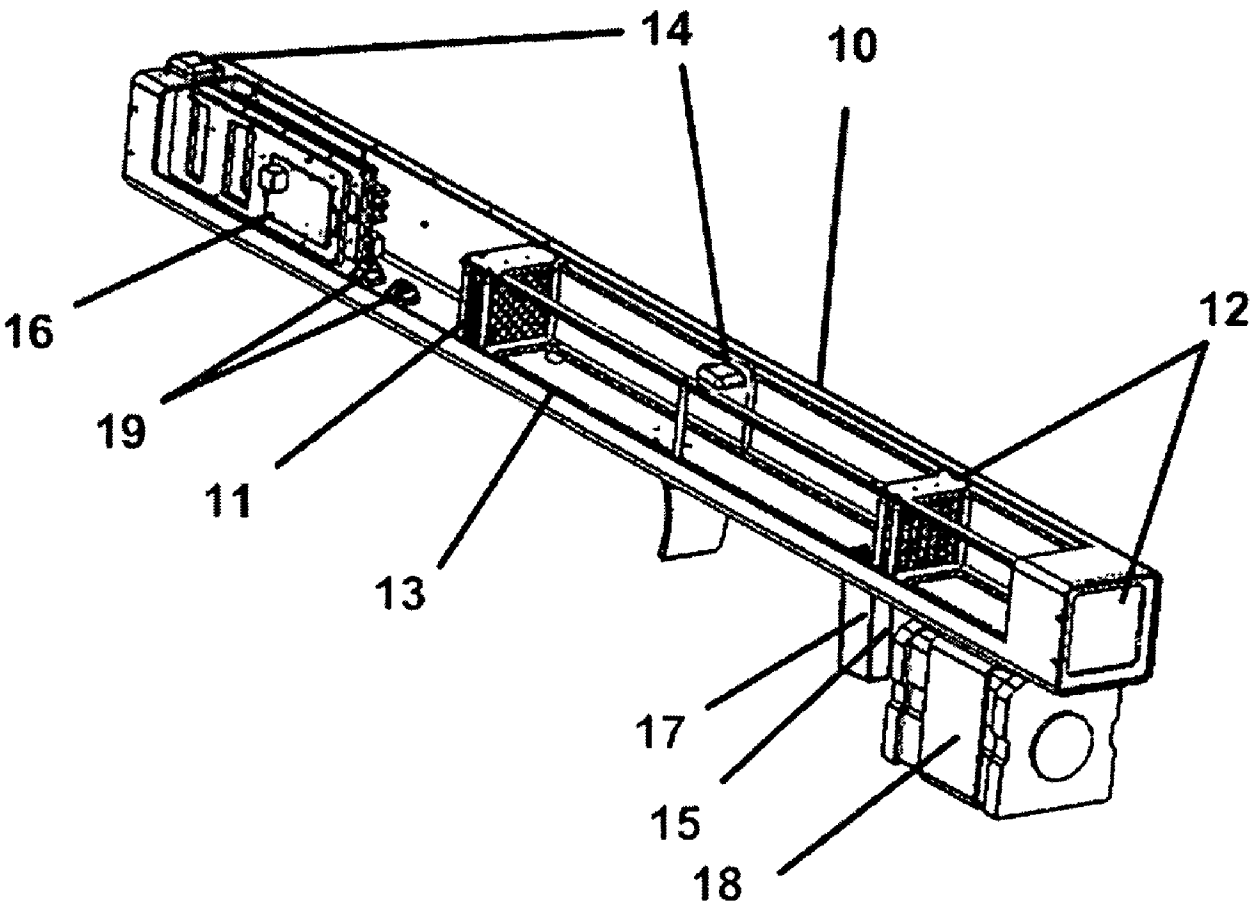
FIG. 1 is a perspective diagram of a high-power embodiment of a missile UV-signature simulator according to the present invention. A portion of the cover of the simulator chassis is not shown in order to better show the interior components of the simulator.

Referring to FIG. 1, a high-power embodiment of a missile UV-signature simulator includes a chassis 10, together with an array of solid state UV radiation emitters 11, a set of beam focusing optics 12, an optical alignment mount 13, a set of position and attitude sensors 14, operator controls 15, control electronics 16 and a handgrip 17, all of which are mounted on the chassis 10. The operator controls 15 are mounted on the handgrip 17, and thereby mounted on the chassis 10. The set of beam focusing optics 12 are held in fixed positions in relation to the radiation emitter array 11 by the optical alignment mounts 13. A documentation camera 18 and testing-and-training-interface connectors 19 are also mounted on the chassis 10.

The chassis 10 is adapted for being hand-held while the simulator is being used.

Figure 2:
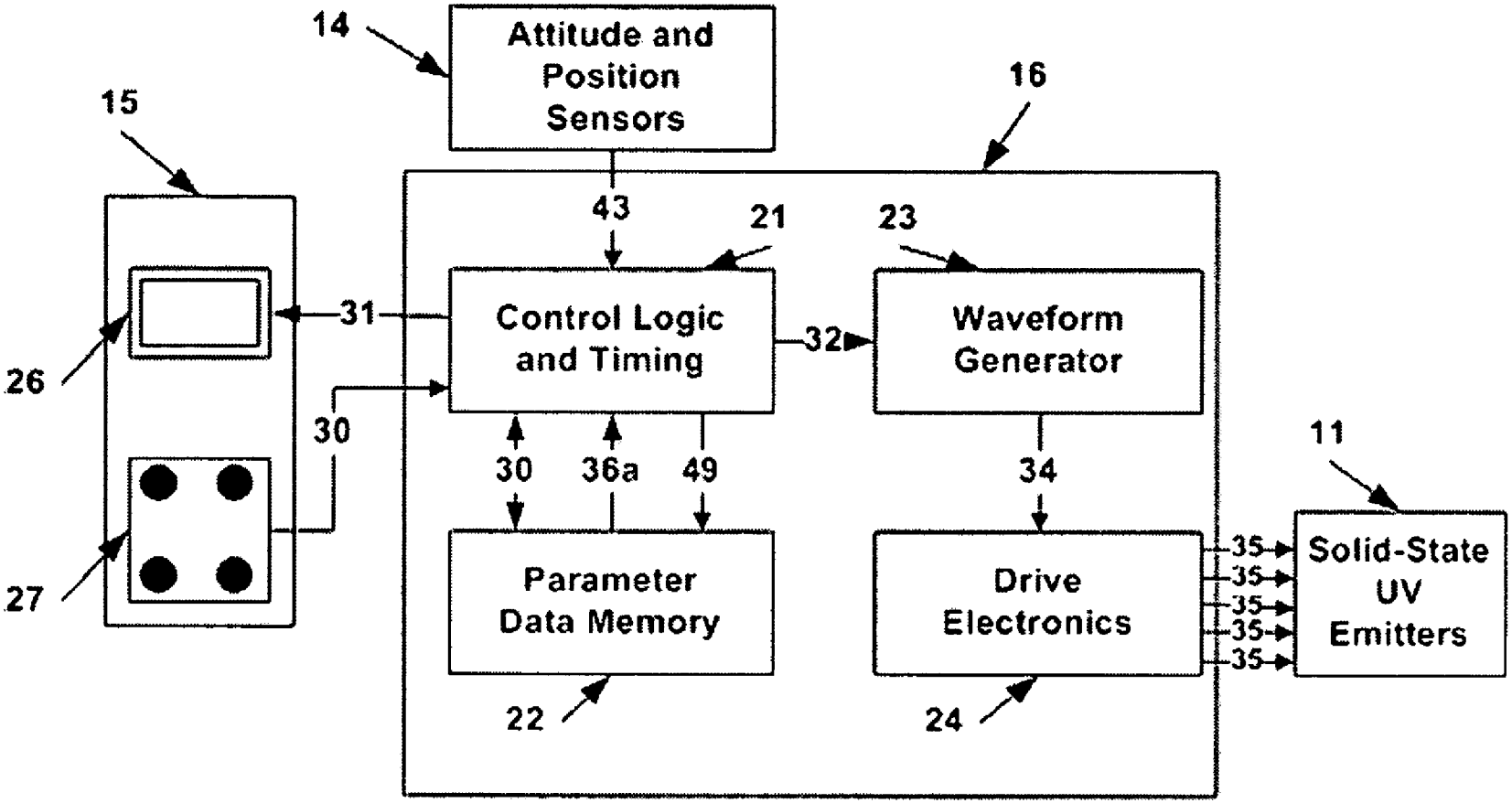
FIG. 2 is a block diagram of the control electronics included in the missile UV-signature simulator shown in FIG. 1, with the control electronics being shown in combination with the operator controls, the position-and-attitude sensors and the array of solid state UV-radiation emitters that are also included in the missile UV-signature simulator.

Referring to FIG. 2, the control electronics 16 includes a control-logic-and-timing section 21, a parameter storage memory 22, a waveform generator 23 and drive electronics 24. The operator controls 15 include a display 26 and a set of switches 27. The parameter storage memory 22 stores missile parameter data representing missile operating conditions of different types of missiles for different missile engagement timing characteristics.

An operator of the missile UV-signature simulator operates the switches 27 to select 30 at least one of one or more different types of missiles and the engagement timing characteristics for simulation. Menus and prompts 31 for such selections are provided from the control-logic-and-timing section 21 to the operator via the display 26.

The control logic and timing section 21 responds to the operator's selection 30 by retrieving from the memory 22 the missile parameter data that represents the missile operating conditions of the selected type(s) of missile(s) for the selected engagement timing characteristics. The control logic and timing section 21 then processes the retrieved missile parameter data in combination with data provided by the position and attitude sensors 14 to provide waveform data 32 that is characteristic of the UV signature of the selected type(s) of missile(s) for the selected engagement timing characteristics.

The waveform generator 23 uses the waveform data 32 to generate a waveform signal 34 simulating the UV signature(s) of the selected type(s) of missile(s). The waveform signal 34 represents the required amount of UV energy to be radiated.

The drive electronics 24 include precision solid state components that respond to the generated waveform signal 34 by providing analog signals 35 that cause the solid state UV-radiation emitters 11 to emit UV radiation simulating the UV-signature(s) of the selected type(s) of missile(s).

The beam focusing optics 12 mounted on the chassis 10 focus the UV radiation emitted by the solid state UV emitters 11 into a radiation beam that simulates the UV-signature(s) of the selected type(s) of missile(s). The solid state UV emitters 11 are light emitting diodes (LED's).

The high-power embodiment provides sufficient energy in the radiated simulated missile UV-signature for testing and training activities at extended ranges such as outdoor test ranges and outdoor training ranges.

The documentation camera 18 and the position and attitude sensors 14 record and measure the parameters of a testing or training event. The testing-and-training-interface connectors 19 provide for electronically connecting the missile UV-signature simulator to other testing and training equipment for synchronization, control, and status observations, along with the ability to download high dynamic UV intensity profiles for missile and false target simulation.

Figure 3A:
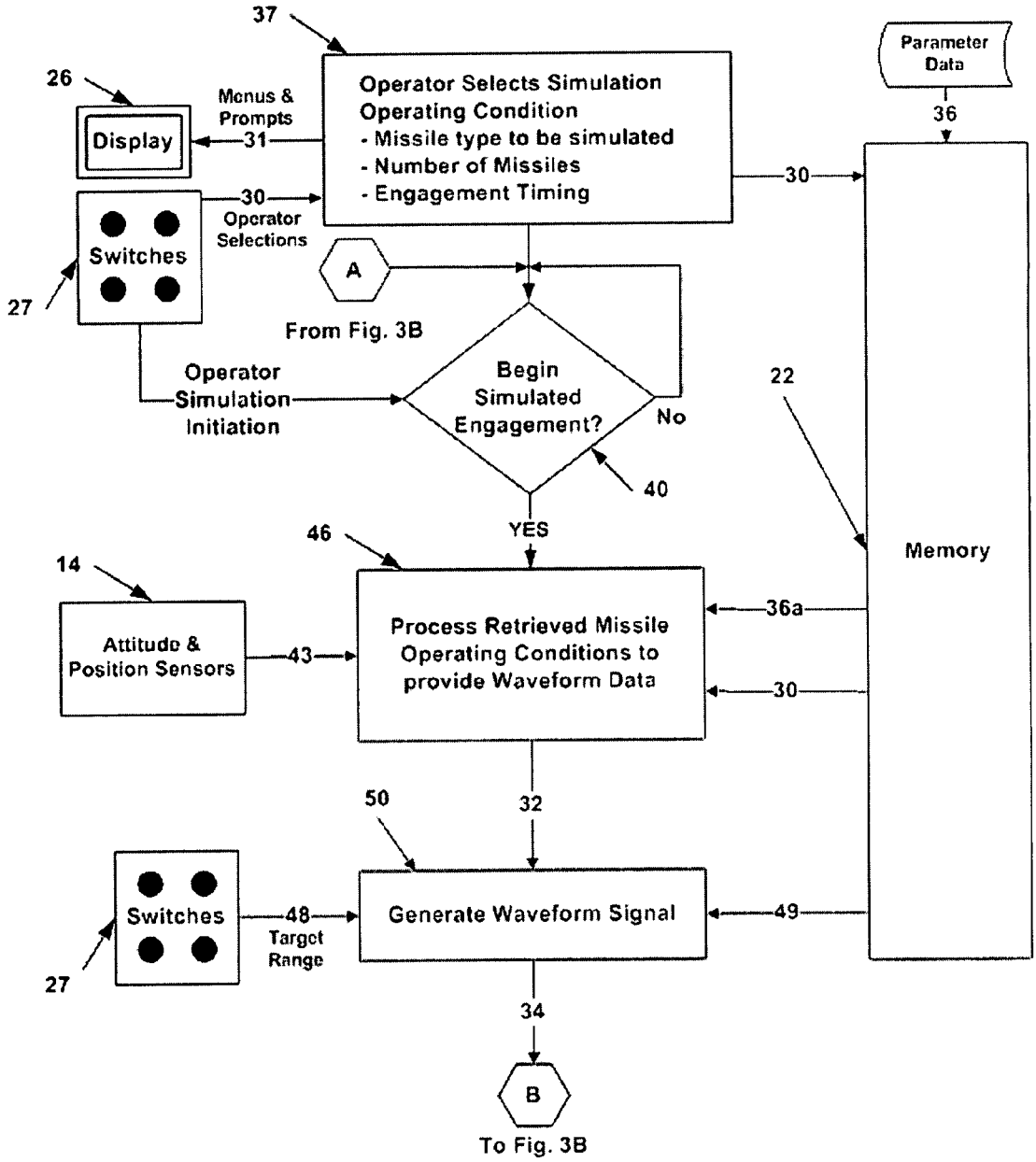
FIGS. 3A and 3B in combination present a flow diagram of the operation of the missile UV-signature simulator shown in FIG. 1.
Figure 3B:
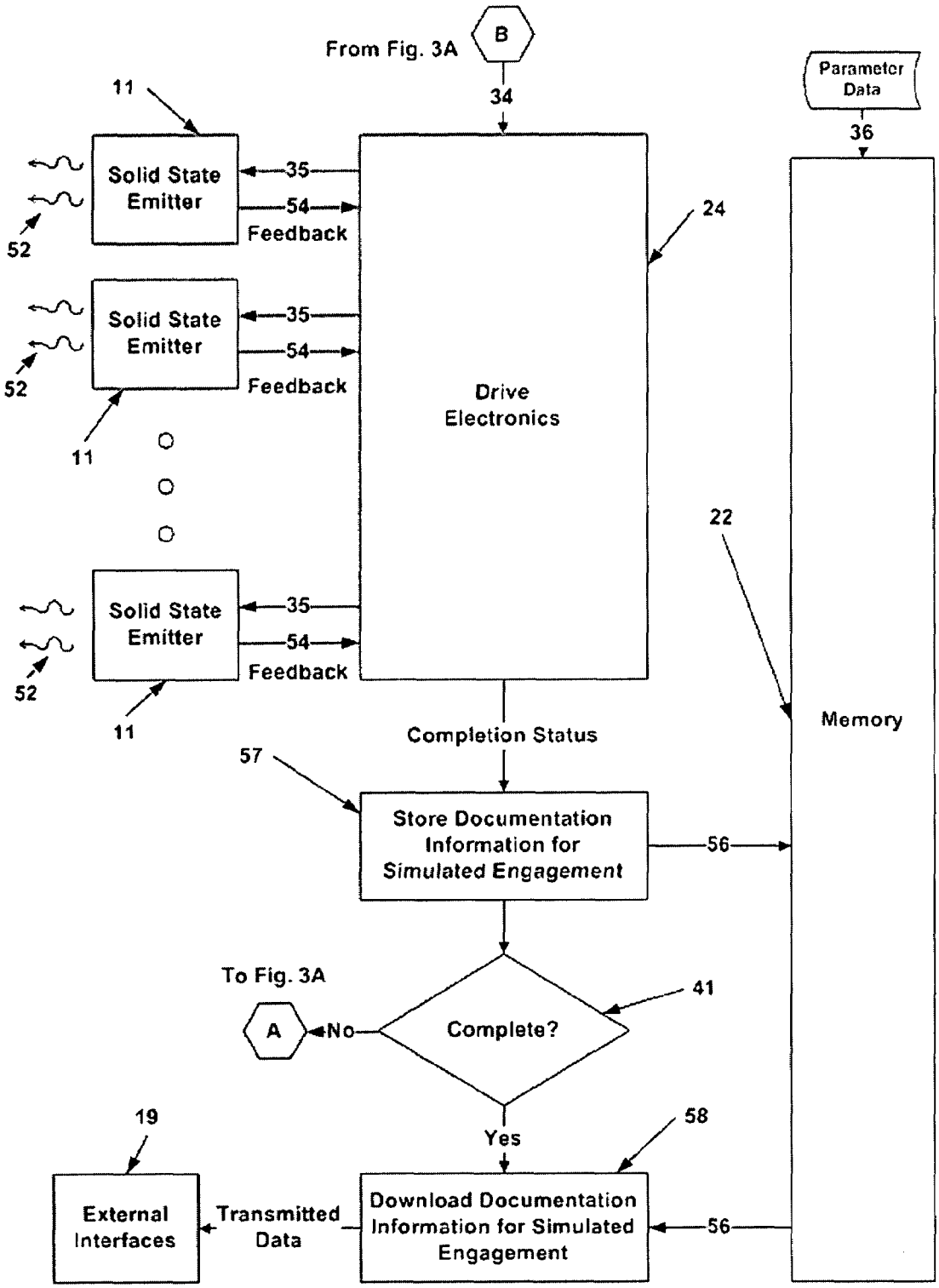

The control and timing functions of the control logic and timing section 21 and the function of the waveform generator 23 are described with reference to the operational flow diagram of the high-power embodiment of the UV-signature simulator shown in the combination of FIGS. 3A and 3B.

Prior to use of the high-power embodiment of the missile UV-signature simulator, missile parameter data 36 representing different missile operating conditions is loaded into the parameter storage memory 22. The missile operating conditions include missile launch and flight characteristics, such as impulse energy, acceleration, flight event timing, such as duration of eject, boost and sustain missile motor operation; and missile UV irradiance levels. Multiple sets of operating conditions are loaded for different types of missiles and different engagement timing characteristics.

At the beginning of a simulation session, an operator uses the switches 27 to select specific details 30 of a missile engagement that is to be simulated, such as the missile type, the number of missiles and the engagement timing, as shown at 37. The operator selects the engagement details 30 from menus and prompts 31 that are provided on the display 26. The selected engagement details 30 are retained in the memory 22 for use during the simulation session.

After the missile engagement details 30 have been selected, the operator begins the simulation by using the switches 27 in accordance with the content of the display 26. The simulation will then commence, provided that a prior simulated missile engagement session has been completed, as shown at 40 and 41.

Missile operating conditions 36*a* for the selected missile engagement are retrieved from the memory 22 in accordance with the selected engagement details 30 specifying the missile type, the number of missiles and the engagement timing. The retrieved missile operating conditions 36*a* include the missile launch and flight characteristics of the selected missile(s).

The selected engagement details 30 are also retrieved from the memory 22 and are processed by the control logic and timing section 21 (FIG. 2) together with the retrieved missile operating conditions 36*a* and position and sensor data 43 provided from the attitude and position sensor 14 to determine the simulation event parameters of the waveform data 32, as shown at 46. The simulation event parameters include the timing and duration of various simulated missile phases, such as missile ejection from the launch tube, missile boost and sustain powered phases, and time of flight. The position and sensor data 43 includes angular rate data, which is determined by the orientation of the hand-held simulator.

The waveform generator 23 (FIG. 2) processes the waveform data 32 together with target range data 48 and missile-UV-irradiance data 49 retrieved from the memory 22 to generate a digital waveform signal 34, as shown at 50. The operator provides the target range data 48 by using the switches 27. The missile-UV-irradiance data 49 is retrieved from the memory 22 in accordance with the selected engagement details 30 specifying the missile type and the number of missiles. The UV-irradiance data 49 is characteristic of the UV-irradiance signature(s) of the missile(s) as a function of time.

The drive electronics 24 respond to the digital waveform signal 34 by providing analog signals 35 that cause the solid state UV-radiation emitters 11 to emit UV radiation 52 simulating the UV-signature(s) of the type(s) of missile(s) selected for the simulation. The analog signals 35 allocate the UV irradiance among the multiple emitters 11, and generate a precision drive for each. Feedback signals 54 are provided to the drive electronics 24 from each emitter 11. The drive electronics 24 use the feedback signals 54 to both control the UV radiation 52 with precision and to perform a test function to confirm proper simulator operation.

The status of the operation of the simulator also is provided to the operator via the display 26.

Upon completion of the simulation session, engagement documentation information 56 is stored in the memory 22, as shown at 57. The engagement documentation information 56 includes the time and characteristics of the simulated engagement, such as the time of engagement, the type(s) of missile(s) simulated, the estimated target range, the simulator position and the simulated UV irradiance waveform. The simulator is then ready for further simulation sessions, as shown at 41.

At the conclusion of the simulation session, the stored engagement documentation information 56 is retrieved from the memory 22, as shown at 58, and downloaded via the interface connectors 19 for documentation and analysis of the simulated engagement.

Figure 4:
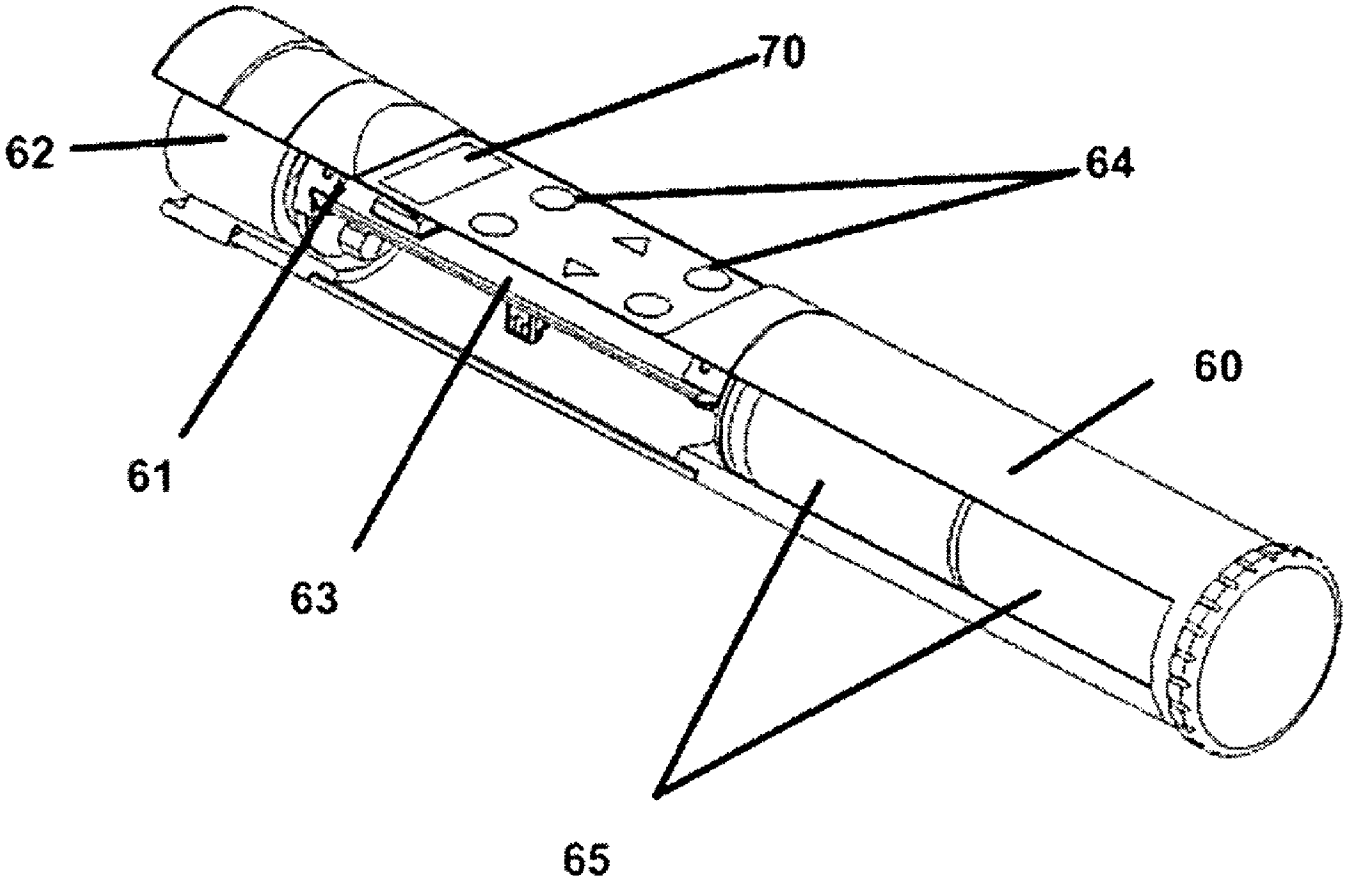
FIG. 4 is a perspective diagram of a low-power embodiment of a missile UV-signature simulator according to the present invention. A portion of the cover of the simulator chassis is not shown in order to better show the interior components.

Referring to FIG. 4, a low-power embodiment of a missile UV-signature simulator includes a chassis 60, together with a solid state UV radiation emitter 61, beam focusing optics 62, control electronics 63, operator control switches 64 and a display 70, all of which are mounted on the chassis 60. The low-power embodiment is powered by batteries 65. The focusing optics 62 are adapted for attenuating and filtering the radiation emitted by the solid state UV emitter 61. The chassis 60 is adapted for being hand-held while the simulator is being used.

The low power embodiment radiates less energy and is appropriate for testing and training at closer ranges of laboratory, classroom, manufacturing, vehicle maintenance, and preoperational (e.g. flight line) test environments.

Figure 5:
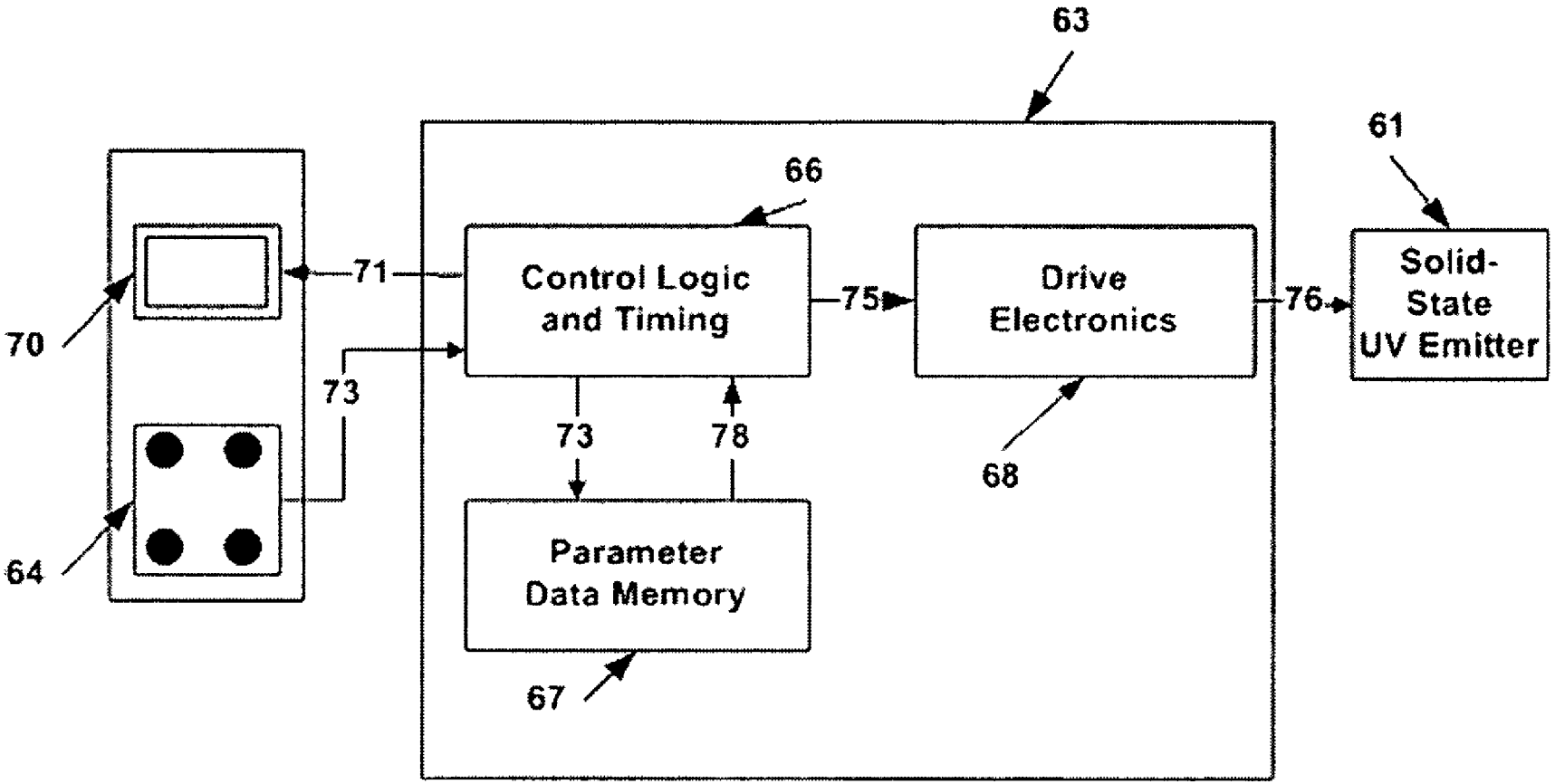
FIG. 5 is a block diagram of the control electronics included in the missile UV-signature simulator shown in FIG. 4, with the control electronics being shown in combination with operator control switches, a display and a solid state UV-radiation emitter that are also included in the missile UV-signature simulator.

Referring to FIG. 5, the control electronics 63 includes a control-logic-and-timing section 66, a parameter data memory 67 and drive electronics 68. The parameter data memory 67 stores missile parameter data 78 representing UV-irradiance sequences of different missile operating conditions for different types of missiles and different ranges.

An operator of the missile UV-signature simulator operates the control switches 64 to select a missile type and a range for a simulation session. Menus and prompts 71 for such selections 73 are provided from the control-logic-and-timing section 66 to the operator via the display 70.

The control logic and timing section 66 responds to the operator's selections 73 by retrieving from the memory 67 the missile parameter data 78 that represents the UV-irradiance sequence of the missile operating conditions of the selected type of missile for the selected range. The control logic and timing section 66 then processes the retrieved missile parameter data 78 to generate a waveform signal 75 simulating the UV signature of the selected type of missile. The waveform signal 75 represents the required amount of UV energy to be radiated.

The drive electronics 68 include precision solid state components that respond to the generated waveform signal 75 by providing an analog signal 76 that causes the solid state UV-radiation emitter 61 to emit UV radiation simulating the UV-signature of the selected type of missile.

Figure 6:
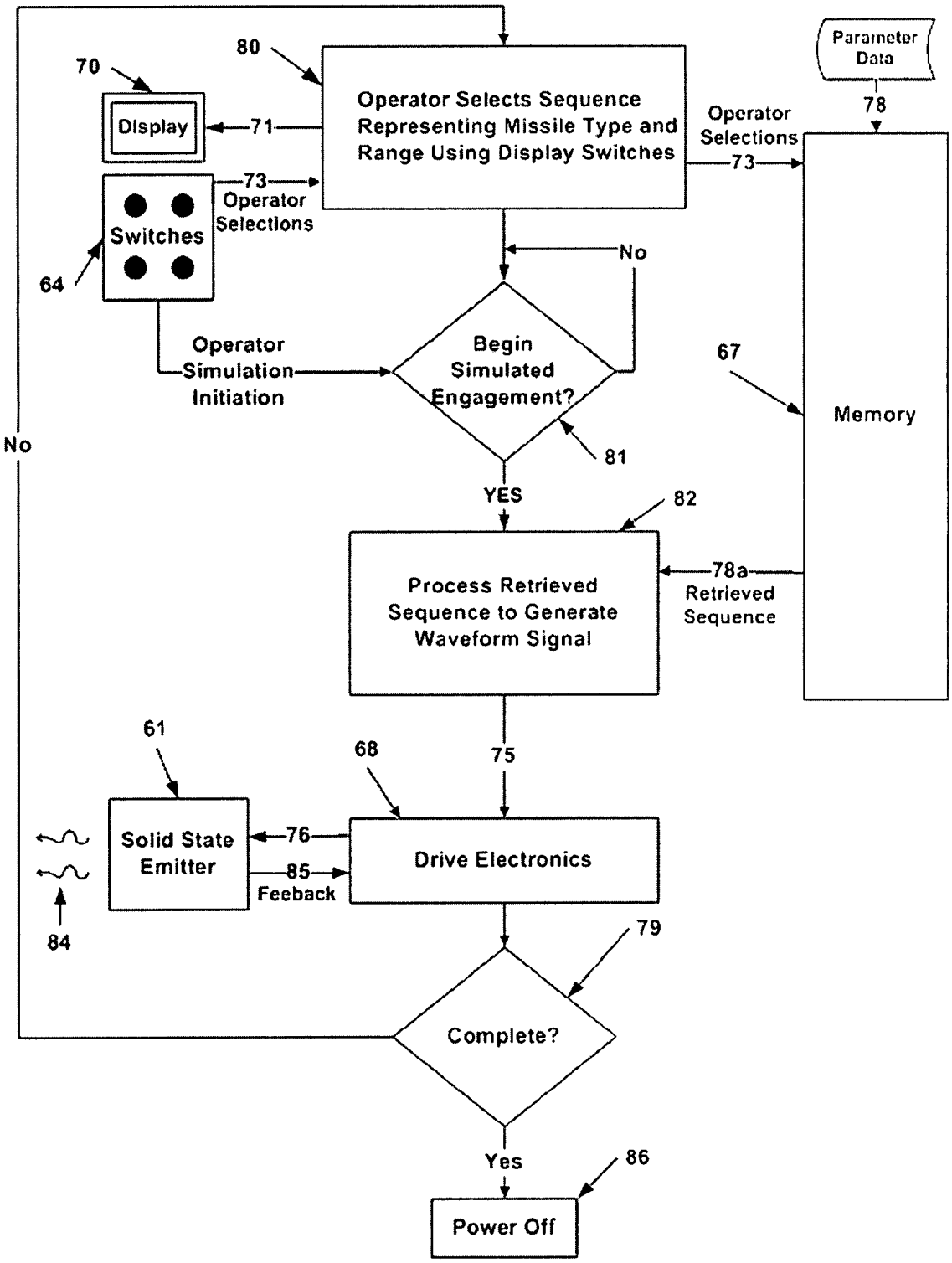
FIG. 6 is a flow diagram of the operation of the missile UV-signature simulator shown in FIG. 4.

The beam focusing optics 62 mounted on the chassis 60 focuses the UV radiation emitted by the solid state UV emitter 61 into a radiation beam that simulates the UV-signature of the selected type of missile. The solid state UV emitter 61 is an LED. The control and timing functions of the control-logic-and-timing section 66 is described with reference to the operational flow diagram of the low-power embodiment of the UV-signature simulator shown in FIG. 6.

Prior to use of the low-power embodiment of the missile UV-signature simulator, missile parameter data 78 representing UV-irradiance sequences of different missile operating conditions for different types of missiles and different ranges is loaded into the parameter storage memory 67. The missile operating conditions include missile launch and flight characteristics, such as impulse energy, acceleration, flight event timing, such as duration of eject, boost and sustain missile motor operation, and engagement timing. Multiple sets of missile operating conditions are loaded for different types of missiles and different ranges.

At the beginning of a simulated missile engagement session, after a prior simulated session has been completed, as shown at 79, an operator uses the switches 64 to select specific details 73 of a missile engagement that is to be simulated, such as the missile type and the range, as shown at 80. The operator selects the engagement details 73 from the menus and prompts 71 that are provided on the display 70.

After the missile engagement details 73 have been selected, the operator begins the simulation by using the switches 64 in accordance with the content of the display 70. The simulation will then commence, as shown at 81.

Missile parameter data 78*a* representing the UV-irradiance sequence of the selected missile over the selected range is retrieved from the memory 67 in accordance with the selected engagement details 73 specifying the missile type and the range, as shown at 82. The retrieved missile parameter data 78*a* is waveform data that is processed by the control logic and timing section 66 (FIG. 5) to generate a digital waveform signal 75 simulating the UV irradiance signature of the selected type of missile as a function of time over the selected range, as also shown at 82.

The drive electronics 68 respond to the digital waveform signal 75 by providing an analog signal 76 that causes the solid state UV-radiation emitter 61 to emit UV radiation 84 simulating the UV-signature of the type of missile selected for the simulation over the selected range. A feedback signal 85 is provided to the drive electronics 68 from the emitter 61. The drive electronics 68 use the feedback signal 85 to both control the UV radiation 84 with precision and to perform a test function to confirm proper simulator operation.

The status of the operation of the simulator also is provided for the operator via the display 70.

Upon completion of a simulation session, the operator is allowed to select specific details 73 of another missile engagement simulations and repeat the operation of the simulator, or to quit and power down the simulator, as shown at 86.

Advantages.

The ability of the solid-state-emitter UV-signature simulator of the present invention to rapidly change energy levels allows the simulated missile UV-signature to more accurately replicate actual missile UV-signatures compared to prior art simulators that use filament light bulbs or arc lamps. This improved UV-signature capability allows testers of MWR systems and vehicles and crews undergoing training activities to perform more precise tests, more realistic training exercises, and have a higher confidence in the outcomes.

The ability of the solid-state-emitter UV-signature simulator of the present invention to radiate energy in the UV energy band without also radiating a false UV-signature in the visible or infrared band provides for more realistic testing and training. For example, the false visible and infrared UV-signatures of filament and arc lamp-based simulators may cause the crews undergoing training to observe a UV-signature during training that does not occur during actual missile engagements. This results in training errors, whereby such crews learn to react to incorrect simulations and thereby may hesitate and perform incorrectly during actual missile engagements.

The scalability of the different embodiments of the solid-state-emitter UV-signature simulator of the present invention allows the simulator to be used for a variety of purposes. Low power embodiments allow operation of the simulator that is close to the MWRs and vehicles, thereby allowing for rapid testing (e.g., flight line) of operating or failed MWRs or vehicle systems. Low power embodiments of the simulator allow for short range testing of the simulators in laboratory or field environments during MWR development and operation testing. High power embodiments of the simulator allow for the testing and training of systems, vehicles, and crews in realistic operating environments and distances, such as force-on-force operational testing, and single or multi-unit realistic training scenarios.

The extended operating life of the solid-state radiation emitters, without having to replace bulbs, provides improved reliability, improves the likelihood of operation when needed, and lowers the cost of ownership. The high electrical efficiency of the solid-state-emitter UV-signature simulator of the present invention allows for operation with minimal electrical power requirements. Thus, low power embodiments may be operated using easily available batteries.

The advantages specifically stated herein do not necessarily apply to every conceivable embodiment of the present invention. Further, such stated benefits of the present invention are only examples and should not be construed as the only benefits of the present invention.

While the above description contains many specificities, these specificities are not to be construed as limitations on the scope of the present invention, but rather as examples of various features of the embodiments described herein. Alternative embodiments are also within the scope of the present invention, which scope should be determined not by the embodiments described herein but rather by the claims and their legal equivalents. The claims require no implicit limitations. Each claim is to be construed explicitly as stated, or by its legal equivalent.

The invention claimed is:

1. Apparatus for simulating ultraviolet (UV) signatures of a missile, comprising:

means for providing waveform data that is characteristic of a UV-signature of a missile;

means for processing the waveform data to generate a waveform signal simulating the UV-signature of the missile;

means for emitting UV-radiation; and drive means for responding to the generated waveform signal by causing the means for emitting UV-radiation to emit UV radiation simulating the UV-signature of the missile;

wherein the means for emitting UV-radiation comprises at least one solid state UV radiation emitter.

2. Apparatus according to claim 1, further comprising:

a memory storing missile parameter data representing missile operating conditions of different types of missiles for different missile engagement timing characteristics;

means for selecting a type of missile and the engagement timing characteristics for simulation; and means for retrieving from the memory missile parameter data that represents the missile operating conditions of the selected type of missile for the selected engagement timing characteristics;

wherein the means for providing the waveform data is adapted for processing the retrieved missile parameter data to provide the waveform data.

3. Apparatus according to claim 2, wherein the means for providing the waveform data is further adapted for processing position and sensor data for the apparatus in combination with the retrieved parameter data to provide the waveform data.

4. Apparatus according to claim 2 contained within a common chassis, wherein the chassis is adapted for being hand-held while the apparatus is being used.

5. Apparatus according to claim 4, further comprising:

a hand grip for gripping the chassis, wherein the selecting means are mounted on the hand grip.

6. Apparatus according to claim 5, wherein the selecting means comprise:

a monitor for displaying selection choices; and switches for making the selections.

7. Apparatus according to claim 1, further comprising:

a memory storing missile parameter data representing missile operating conditions of different types of missiles for different missile engagement timing characteristics;

means for selecting at least one of one or more different types of missiles and the engagement timing characteristics for simulation; and means for retrieving from the memory missile parameter data that represents the missile operating conditions of the selected type(s) of missile for the selected engagement timing characteristics;

wherein the means for providing the waveform data is adapted for processing the retrieved missile parameter data to provide the waveform data.

8. Apparatus according to claim 7, wherein the means for providing the waveform data is further adapted for processing position and sensor data for the apparatus in combination with the retrieved parameter data to provide the waveform data.

9. Apparatus according to claim 7 contained within a common chassis, wherein the chassis is adapted for being hand-held while the apparatus is being used.

10. Apparatus according to claim 9, further comprising:

a hand grip for gripping the chassis, wherein the selecting means are mounted on the hand grip.

11. Apparatus according to claim 10, wherein the selecting means comprise:

a monitor for displaying selection choices; and switches for making the selections.

12. Apparatus according to claim 1, further comprising:

a memory storing missile parameter data representing UV-irradiance sequences of missile operating conditions of different types of missiles for different ranges;

means for selecting a type of missile and a range for simulation; and means for retrieving from the memory missile parameter data that represents the UV-irradiance sequence of the missile operating conditions of the selected type of missile for the selected range;

wherein the means for providing the waveform data is adapted for processing the retrieved missile parameter data to provide the waveform data.

13. Apparatus according to claim 12 contained within a common chassis, wherein the chassis is adapted for being hand-held while the apparatus is being used.

14. Apparatus according to claim 13, wherein the selecting means comprise:

a monitor for displaying selection choices; and switches for making the selections.

15. Apparatus according to claim 1 contained within a common chassis, wherein the chassis is adapted for being hand-held while the apparatus is being used.

16. Apparatus according to claim 15, in combination with a camera mounted on the chassis for recording the simulation.

* * * * *